US007091917B2

(12) United States Patent
Jan et al.

(10) Patent No.: US 7,091,917 B2
(45) Date of Patent: Aug. 15, 2006

(54) COMPLEX ANTENNA APPARATUS

(75) Inventors: Cheng-Geng Jan, Hsichih (TW); Shun-Chung Kuo, Hsichih (TW)

(73) Assignee: Wistron NeWeb Corp., Taipei Hsien (TW)

( * ) Notice: Subject to any disclaimer, the term of this patent is extended or adjusted under 35 U.S.C. 154(b) by 18 days.

(21) Appl. No.: 10/628,892

(22) Filed: Jul. 28, 2003

(65) Prior Publication Data

US 2004/0222935 A1 Nov. 11, 2004

(30) Foreign Application Priority Data

Apr. 23, 2003 (TW) ..... 92109462 A

(51) Int. Cl.
*H01Q 21/00* (2006.01)
*H01Q 9/04* (2006.01)

(52) U.S. Cl. ..... 343/725; 343/700 MS; 343/790; 343/729; 343/829; 343/895

(58) Field of Classification Search ..... 343/700 MS, 343/725, 729, 829, 846, 895, 702, 728, 790, 343/703, 739, 752, 826, 741, 722, 357, 749–750, 343/856, 850, 860, 864, 713
See application file for complete search history.

(56) References Cited

U.S. PATENT DOCUMENTS 5,016,022 A * 5/1991 Kershaw ..... 343/750
5,057,848 A * 10/1991 Rankin et al. ..... 343/703
5,300,936 A * 4/1994 Izadian ..... 343/700 MS
5,610,620 A * 3/1997 Stites et al. ..... 343/725
5,831,577 A * 11/1998 Nichols et al. ..... 342/357.03
6,150,984 A * 11/2000 Suguro et al. ..... 343/702
6,160,512 A * 12/2000 Desclos et al. ..... 343/700 MS
6,181,286 B1 * 1/2001 Roscoe et al. ..... 343/725
6,229,488 B1 * 5/2001 Lin et al. ..... 343/700 MS
6,313,801 B1 * 11/2001 Sanford et al. ..... 343/725
6,320,549 B1 * 11/2001 Nybeck et al. ..... 343/727
6,334,048 B1 * 12/2001 Edvardsson et al. ..... 455/575.7
6,476,773 B1 11/2002 Palmer et al.
6,483,465 B1 11/2002 Itoh et al.
6,483,471 B1 11/2002 Petros
6,538,611 B1 * 3/2003 Noro ..... 343/725
6,778,149 B1 * 8/2004 Fukae et al. ..... 343/895
6,839,033 B1 * 1/2005 Shimabara et al. ..... 343/702
2003/0210193 A1 * 11/2003 Rossman et al. ..... 343/725
2004/0017327 A1 * 1/2004 Petropoulos ..... 343/895

* cited by examiner

*Primary Examiner*—Don Wong
*Assistant Examiner*—Chuc Tran
(74) *Attorney, Agent, or Firm*—Quintero Law Office

(57) ABSTRACT

A complex antenna apparatus including a base, a circular polarization antenna and a capacitance (inductance) cylinder loading monopole antenna. The base has a central through hole. The circular polarization antenna is disposed on the base and has a hollow feeding portion corresponding to the central through hole. The capacitance (inductance) cylinder loading monopole antenna is fixed on the base by inserting one end of the capacitance (inductance) cylinder loading monopole antenna into the central through hole.

11 Claims, 7 Drawing Sheets

COMPLEX ANTENNA APPARATUS

BACKGROUND OF THE INVENTION

1. Field of the Invention

The present invention relates to a complex antenna apparatus, and in particular to a complex antenna apparatus that simultaneously receives radio signals from satellites and base stations on earth.

2. Description of the Related Art

Referring to FIG. 1A and FIG. 1B, U.S. Pat. No. 6,483,465 discloses a circularly polarized wave antenna 10 which allows the matching of resonant frequencies in a higher order mode to be easily achieved. In this circularly polarized wave antenna 10, a flat portion 12*a* is provided by flattening a portion of the peripheral side surface of a substrate 11. Two feeding electrodes 17, 18 for use in the higher order mode excitation are formed on the flat portion 12*a*. Additionally, a circular radiation electrode 14 is formed on a main surface 13 of the substrate 11 while a ground electrode 16 is formed on the other main surface 15 of the substrate 11. The circularly polarized wave antenna 10 simply receives radio signals from satellites.

Referring to FIG. 2, U.S. Pat. No. 6,483,471 discloses a complex antenna 40 having a quadrifilar helix antenna 49 and a dipole antenna 44. The quadrifilar helix antenna 49 has a first coaxial cable 46, and the dipole antenna 44 has a linear polarization portion and a second coaxial cable 42. The linear polarization portion is external to the quadrifilar helix antenna 49. Accordingly, the complex antenna 40 can simultaneously receives radio signals from satellites and base stations. Nevertheless, the complex antenna 40 has a large length or height and the volume thereof cannot be reduced, thereby causing inconvenience when carried by an object.

Referring to FIG. 3, U.S. Pat. No. 6,476,773 discloses an antenna array 120 formed on a deformable dielectric material or substrate 122. The antenna array 120 has a center element 130 and a plurality of radial elements 126 extending from a center hub 128. In the operative mode, the radial elements 126 are folded upwardly into an approximately vertical position, with the center element 130 at the center of the center hub 128 and the radial elements 126 circumferentially surrounding the center element 130. When not in use, the antenna array 120 is deformed into a plane and can therefore be integrated into a housing for compact storage. Accordingly, the structure of the antenna array 120 is complex, such that complex assembly steps are needed.

Referring to FIG. 4, a conventional monopole antenna 50 is employed to receive the radio signals from the base stations.

Referring to FIG. 5, a conventional circular polarization antenna 60 is employed to receive the radio signals from the satellites. The circular polarization antenna 60 is disposed on a base 70 having a ground 71 formed thereunder. According to the antenna characteristics, most of the electric current flowing through the circular polarization antenna 60 is aggregated on the peripheral edge thereof. Namely, there is least electric current flowing through the central part of the circular polarization antenna 60.

Generally speaking, there are two types of conventional circular polarization antennas, the cross dipole antenna and quadrifilar helix antenna. In addition to the conventional circular polarization antenna, an additional linear antenna is also needed for receiving the radio signals coming from both the satellites and base stations. Nevertheless, the number of antenna elements and the space required is increased.

Additionally, there are a few drawbacks when the cross dipole antenna or quadrifilar helix antenna is combined with a monopole linear antenna. Additional assembly steps are needed, artificial welding is difficult, and manufacturing costs and time are considerably increased.

Moreover, it is uneasy to tune the impedance match between the cross dipole antenna and monopole linear antenna to meet designer's requirement, thereby increasing the development time thereof. It is not easy to reduce the length or height of the quadrifilar helix, thus makes reduction of the total volume of the quadrifilar helix antenna and monopole linear antenna difficult.

SUMMARY OF THE INVENTION

Accordingly, an object of the invention is to provide a complex antenna apparatus to overcome the aforementioned problems. The complex antenna apparatus comprises a base, a circular polarization antenna and a capacitance (inductance) cylinder loading monopole antenna. The base includes a central through hole. The circular polarization antenna is disposed on the base and has a hollow feeding portion corresponding to the central through hole. The capacitance (inductance) cylinder loading monopole antenna is fixed on the base by inserting one end of the capacitance (inductance) cylinder loading monopole antenna into the central through hole.

Preferably, the capacitance (inductance) cylinder loading monopole antenna further comprises a monopole linear antenna and a conductive element covering the monopole linear antenna.

Preferably, the capacitance (inductance) cylinder loading monopole antenna further comprises a dielectric disposed between the conductive element and monopole linear antenna.

Preferably, the base further comprises a ground formed thereunder.

Preferably, the circular polarization antenna is circular or polygon.

Preferably, the complex antenna apparatus further comprises an RF module. The RF module is connected to the circular polarization antenna and capacitance (inductance) cylinder loading monopole antenna.

Preferably, the base further comprises a through hole. The circular polarization antenna and capacitance (inductance) cylinder loading monopole antenna are connected to the RF module passing through the through hole and central through hole of the base, respectively.

Preferably, the complex antenna apparatus further comprises a demodulator. The demodulator is connected to the RF module.

Preferably, the base is composed of ceramic or printed circuit board.

Preferably, the dielectric is composed of Teflon.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

Figure 1A:
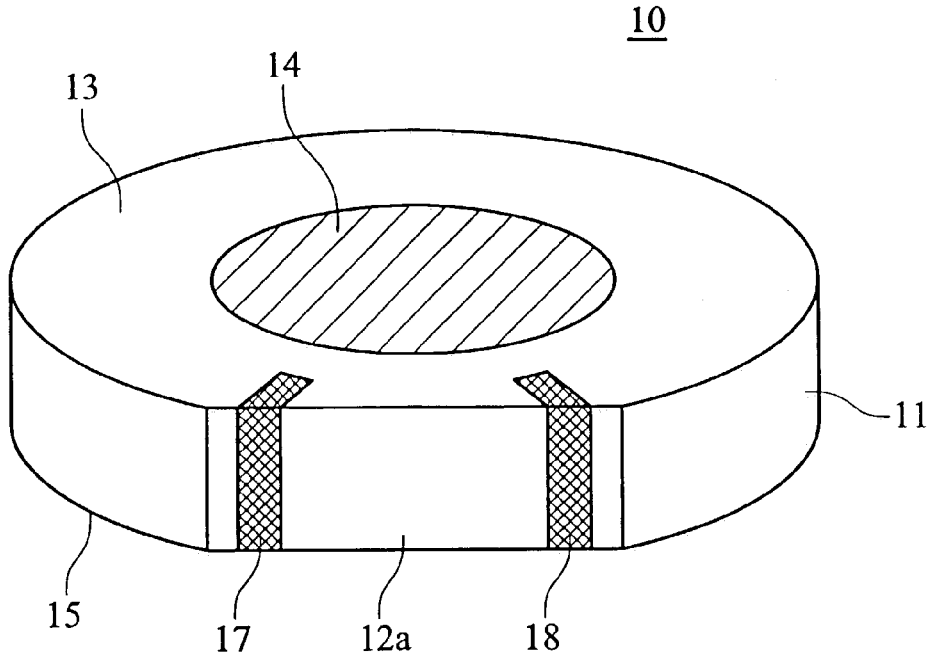
FIG. 1A (PRIOR ART)
FIG. 1A and FIG. 1B show a conventional circular polarization antenna.
Figure 1B:
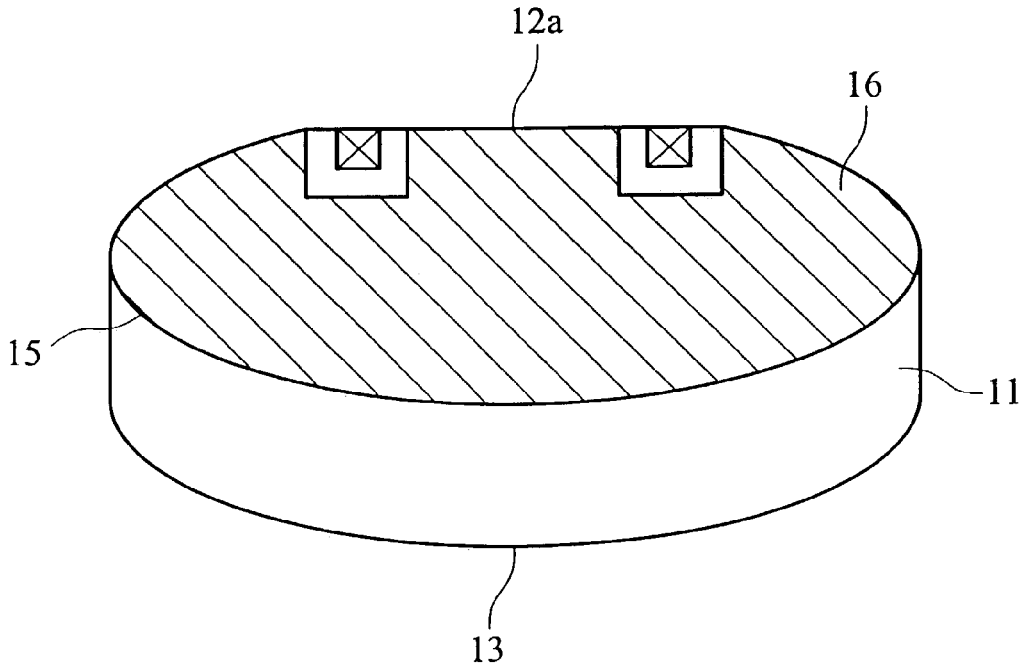
FIG. 1B (PRIOR ART)
Figure 2:
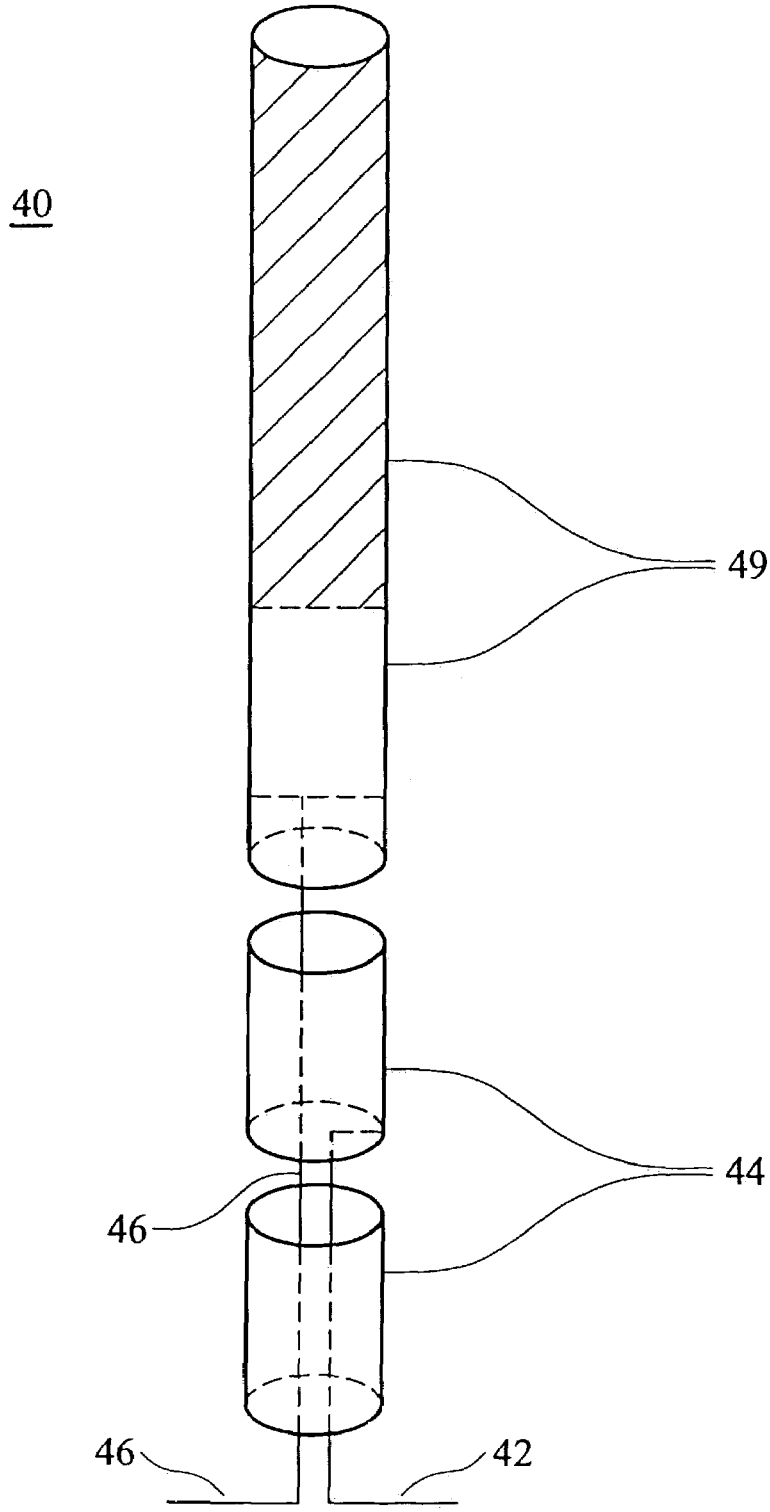
FIG. 2 (PRIOR ART)
FIG. 2 shows a conventional complex antenna.
Figure 3:
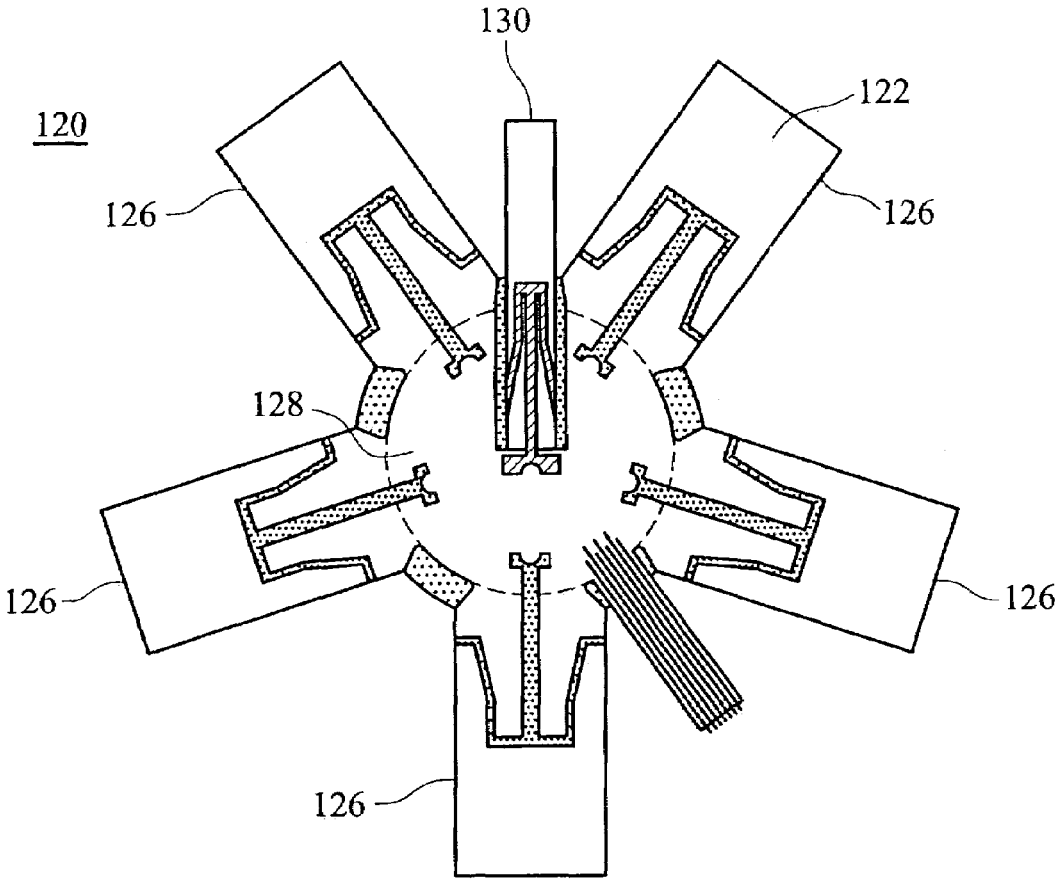
FIG. 3 (PRIOR ART)
FIG. 3 shows a conventional antenna array.
Figure 4:
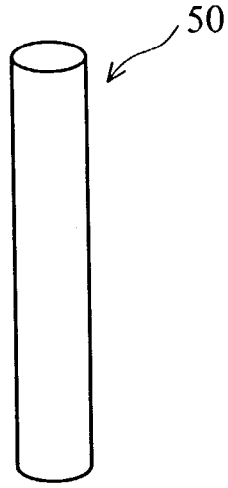
FIG. 4 (PRIOR ART)
FIG. 4 shows a conventional monopole antenna.
Figure 5:
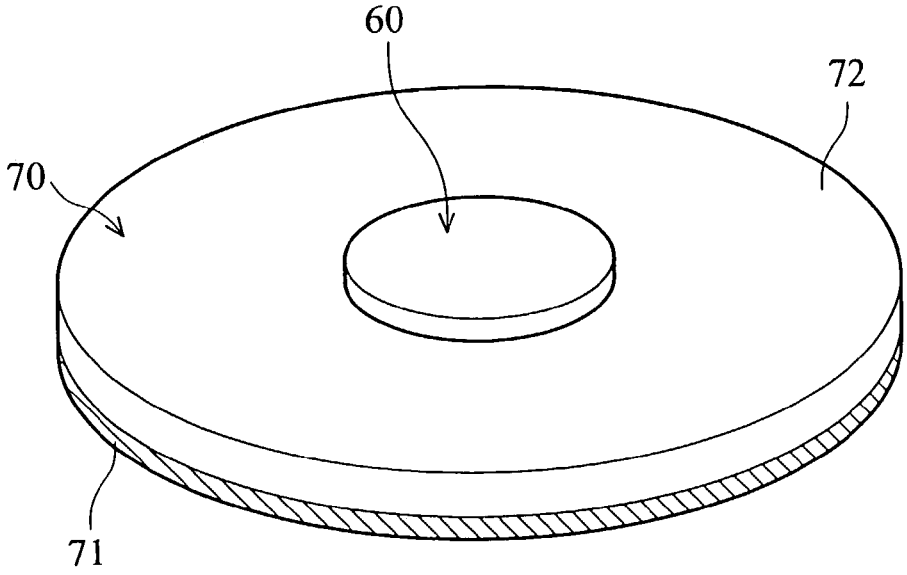
FIG. 5 (PRIOR ART)
FIG. 5 shows a conventional circular polarization antenna.
Figure 6:
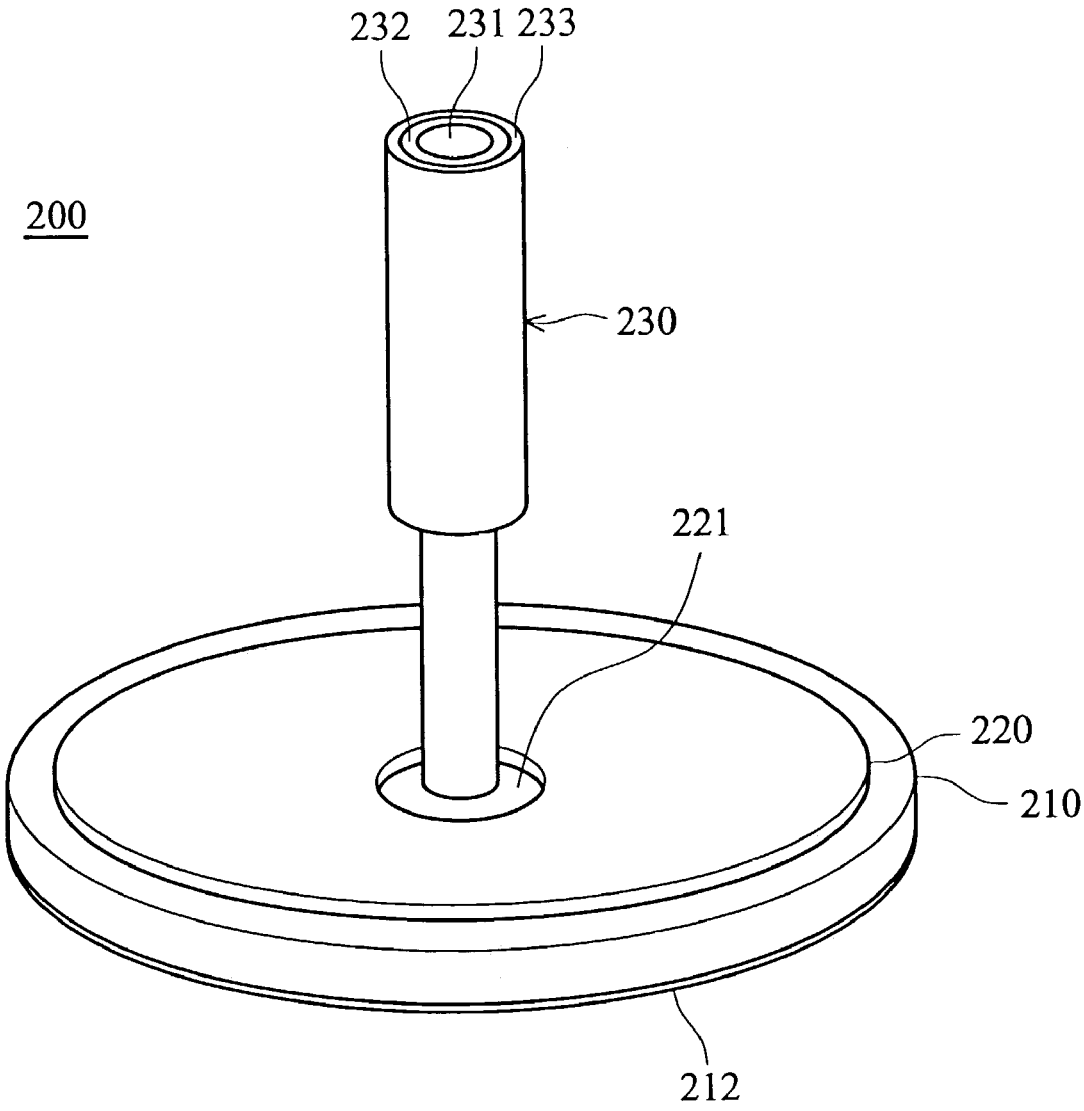
FIG. 6 is a schematic perspective view showing a complex antenna apparatus of the invention.

Referring to FIG. 6, the complex antenna apparatus 200 includes a base 210, a circular polarization antenna 220 and a capacitance (inductance) cylinder loading monopole antenna 230. The circular polarization antenna 220 receives radio signals from satellites while the capacitance (inductance) cylinder loading monopole antenna 230 receives radio signals from base stations on earth.

Figure 7:
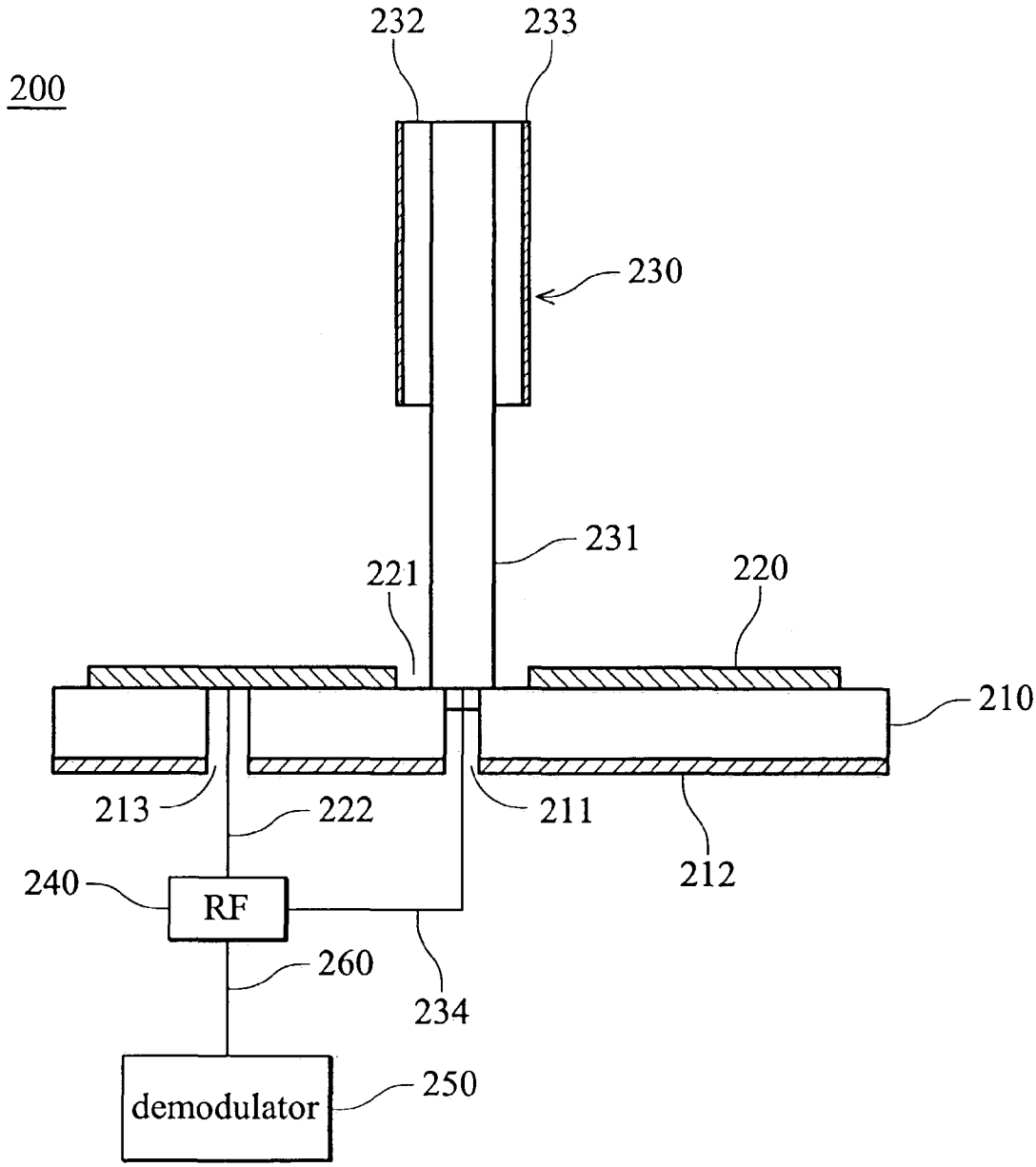
FIG. 7 is a schematic cross section according to FIG. 6.

As shown in FIG. 6 and FIG. 7, a central through hole 211 is formed on the central part of the base 210. The circular polarization antenna 220 is disposed on the base 210 and has a hollow feeding portion 221. Specifically, the position of the hollow feeding portion 221 corresponds to that of the central through hole 211 of the base 210. The capacitance (inductance) cylinder loading monopole antenna 230 is disposed in the central through hole 211 of the base 210 via the hollow feeding portion 221 of the circular polarization antenna 220. Thus, the capacitance (inductance) cylinder loading monopole antenna 230 protrudes from the circular polarization antenna 220 and base 210.

The structure of the capacitance (inductance) cylinder loading monopole antenna 230 is described as follows. As shown in FIG. 6 and FIG. 7, the capacitance (inductance) cylinder loading monopole antenna 230 is composed of a monopole linear antenna 231, a dielectric 232 and a conductive element 233. The dielectric 232, such as Teflon, covers the monopole linear antenna 231. The conductive element 233 then covers the dielectric 232. Thus, the dielectric 232 is between the monopole linear antenna 231 and conductive element 233. As a whole, the conductive element 233 covers the dielectric 232 and monopole linear antenna 231 so that capacitance coupling is generated between the conductive element 233 and monopole linear antenna 231. The height or length of the monopole linear antenna 231, diameter of the monopole linear antenna 231 and value of the dielectric 232 may be relatively adjusted according to the Smith chart to achieve impedance match. The resonant frequency or wavelength of the monopole linear antenna 231 is thus reduced. Namely, because the monopole linear antenna 231 is covered by the conductive element 233, the monopole linear antenna 231 can obtain a higher impedance match value with shorter length. For example, the monopole linear antenna 231 can be designed according to an impedance match value of 50 ohms.

According to the antenna characteristics, there is least electric current flowing through the central part of the circular polarization antenna 220 when the circular polarization antenna 220 is disposed on the base 210. The hollow feeding portion 221 formed on the center of the circular polarization antenna 220 does not adversely affect the capability thereof to receive the satellite signals. Thus, when the capacitance (inductance) cylinder loading monopole antenna 230 is disposed in the central through hole 211 of the base 210 via the hollow feeding portion 221 of the circular polarization antenna 220, the circular polarization antenna 220 and capacitance (inductance) cylinder loading monopole antenna 230 respectively have different electric current routes and do not interfere with each other.

Additionally, the base 210 is composed of ceramic and a ground 212 is formed thereunder. Meanwhile, an RF module 240 and a demodulator 250 are connected to the circular polarization antenna 220 and capacitance (inductance) cylinder loading monopole antenna 230.

Additionally, as shown in FIG. 7, a through hole 213 is formed in the base 210. The through hole 213 may correspond to any part of the circular polarization antenna 220, such that the circular polarization antenna 220 can be connected to the RF module 240 by means of a wire 222 and via the through hole 213. The capacitance (inductance) cylinder loading monopole antenna 230 is connected to the RF module 240 by means of a wire 234 and via the central through hole 211. The RF module 240 is then connected to the demodulator 250 by means of a wire 260.

In addition, the complex antenna apparatus 200 of the invention is not limited to employing the capacitance (inductance) cylinder loading monopole antenna 230 having the monopole linear antenna 231, dielectric 232 and conductive element 233. In other words, the monopole linear antenna 231 or other linear antennas can be directly disposed in the central through hole 211 of the base 210 to simultaneously receive the radio signals from the satellites and base stations with the circular polarization antenna 220.

Figure 8:
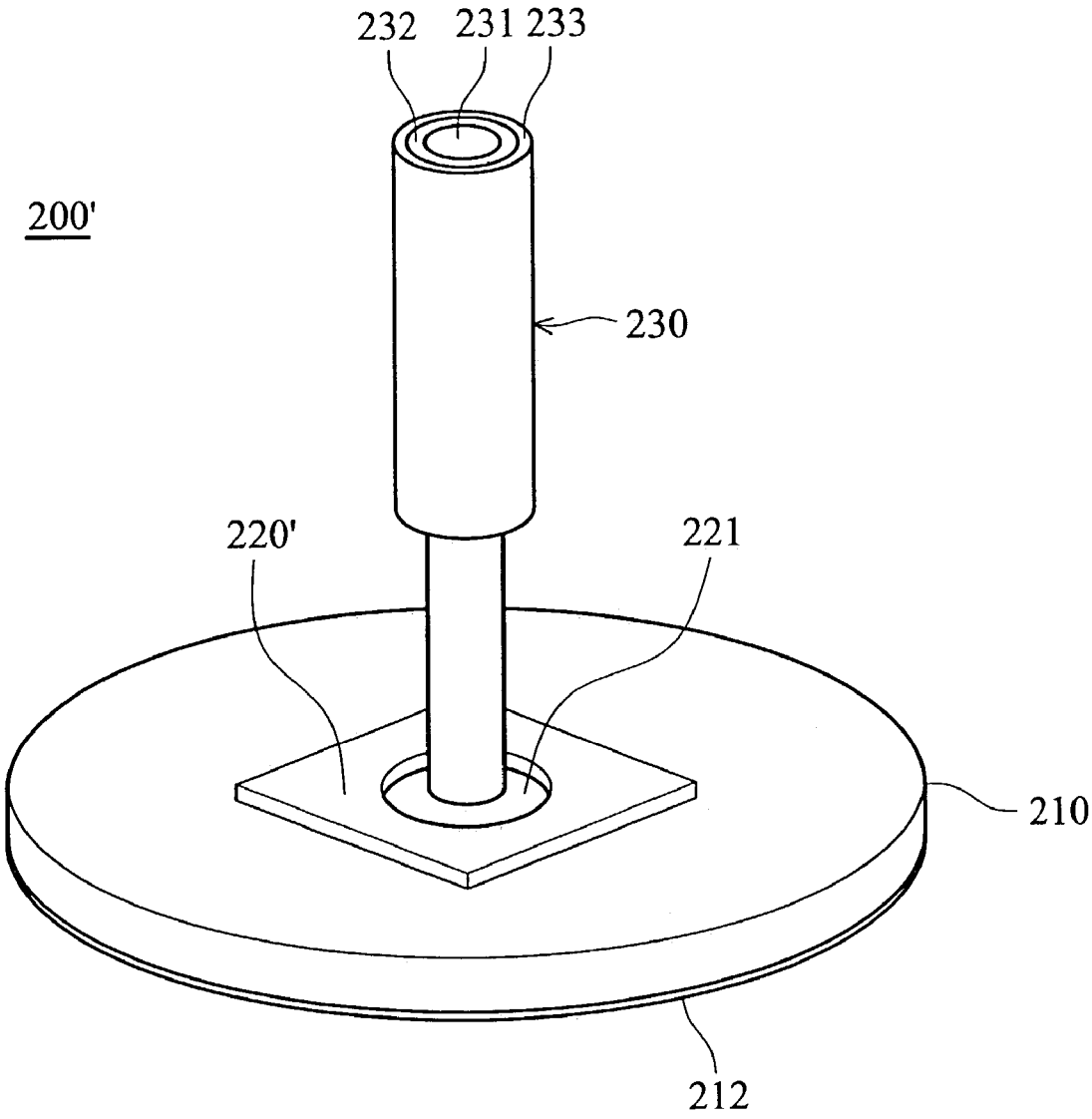
FIG. 8 is a schematic perspective view showing another complex antenna apparatus of the invention.

Moreover, the circular polarization antenna 220 of the invention is not limited to a round shape. For example, the complex antenna apparatus 200' has a rectangular circular polarization antenna 220' as shown in FIG. 8. The capability of the circular polarization antenna 220' to receive radio signals from satellites is the same as that of the circular polarization antenna 220.

Specifically, the central through hole 211 is not limited to being formed in the center of the base 210. That is, even though the central through hole 211 is formed slightly away from the center of the base 210, the complex antenna apparatus 200 can accomplish the same purpose.

In conclusion, the complex antenna apparatus 200, 200' have the following advantages. The development of the complex antenna apparatus 200, 200' is simplified. The ideal dimensions of the complex, antenna apparatus can be readily determined by electromagnetic analysis software, such as IE3D or Ansoft, without complicated design or modification. Since the capacitance (inductance) cylinder loading monopole antenna is disposed in the hollow feeding portion of the circular polarization antenna, the height and total volume of the complex antenna apparatus are effectively reduced. The complex antenna apparatus presents an aesthetically pleasing appearance especially when the complex antenna apparatus is carried by a movable object (such as a vehicle) or a building. Because the complex antenna apparatus has fewer components, the manufacturing costs thereof are reduced. The base of the complex antenna apparatus is composed of ceramic, such that the dimensions thereof can be accurately controlled. The stability of the complex antenna apparatus is thereby enhanced. The complex assembly steps and artificial welding of the cross dipole antenna and quadrifilar helix circular polarization antenna are reduced.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A complex antenna apparatus, comprising:

a base having a central through hole and a ground;

a circular polarization antenna disposed on the base and having a hollow feeding portion corresponding to the central through hole; and a capacitance loading monopole antenna disposed in the central through hole of the base and comprising a monopole linear antenna and a conductive element covering the monopole linear antenna, wherein the conductive element is separated from the ground of the base.

2. The complex antenna apparatus as claimed in claim 1, wherein the capacitance loading monopole antenna further comprises a dielectric disposed between the conductive element and monopole linear antenna.

3. The complex antenna apparatus as claimed in claim 2, wherein the dielectric is Teflon.

4. The complex antenna apparatus as claimed in claim 1, wherein the circular polarization antenna is circular.

5. The complex antenna apparatus as claimed in claim 1, wherein the circular polarization antenna is rectangular.

6. The complex antenna apparatus as claimed in claim 1, further comprising an RF module connected to the circular polarization antenna and capacitance loading monopole antenna.

7. The complex antenna apparatus as claimed in claim 6, wherein the base further comprises a through hole, the circular polarization antenna and capacitance loading monopole antenna connected to the RF module via the through hole and central through hole of the base, respectively.

8. The complex antenna apparatus as claimed in claim 6, further comprising a demodulator connected to the RF module.

9. The complex antenna apparatus as claimed in claim 1, wherein the base is ceramic.

10. A complex antenna apparatus, comprising:

a base having a central through hole;

a circular polarization antenna disposed on the base and having a hollow feeding portion corresponding to the central through hole;

a capacitance loading monopole antenna disposed in the central through hole of the base via the hollow feeding portion of the circular polarization antenna and comprising a monopole linear antenna and a conductive element covering the monopole linear antenna;

an RF module connected to the circular polarization antenna and capacitance loading monopole antenna; and a demodulator connected to the RF module.

11. A complex antenna apparatus, comprising:

a base having a central through hole;

a circular polarization antenna disposed on the base and having a hollow feeding portion corresponding to the central through hole; and a capacitance loading monopole antenna disposed in the central through hole of the base via the hollow feeding portion of the circular polarization antenna and comprising a monopole linear antenna, a conductive element and a dielectric, wherein the conductive element covers the monopole linear antenna, and the dielectric is disposed between the conductive element and the monopole linear antenna.

* * * * *